US008507816B2

(12) United States Patent
Lee et al.

(10) Patent No.: US 8,507,816 B2
(45) Date of Patent: Aug. 13, 2013

(54) KEYPAD FOR ELECTRONIC DEVICE AND METHOD FOR MANUFACTURING THE KEYPAD

(75) Inventors: Yoon-Hee Lee, Incheon (KR); Seung-Chang Baek, Seoul (KR); Young-Ki Kim, Gyeonggi-do (KR); Yong-Wook Hwang, Gyeonggi-do (KR); Jun-Young Lee, Gyeonggi-do (KR); Sung-Wook Kang, Seoul (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 362 days.

(21) Appl. No.: 12/882,316

(22) Filed: Sep. 15, 2010

(65) Prior Publication Data

US 2011/0128165 A1 Jun. 2, 2011

(30) Foreign Application Priority Data

Nov. 27, 2009 (KR) ..... 10-2009-0116259

(51) Int. Cl.
*H01H 13/70* (2006.01)

(52) U.S. Cl.
USPC ..... 200/341; 341/22; 345/169

(58) Field of Classification Search
USPC ..... 200/5 A, 512, 517, 341–345, 310–317; 216/63; 341/22; 345/168–170; 29/622
See application file for complete search history.

(56) References Cited

U.S. PATENT DOCUMENTS

| | | | | |
|---|---|---|---|---|
| 6,345,432 | B1 * | 2/2002 | Bauer et al. | 29/527.1 |
| 7,705,259 | B2 * | 4/2010 | Kenmochi | 200/514 |
| 7,781,690 | B2 * | 8/2010 | Ishii | 200/341 |
| 7,866,032 | B2 * | 1/2011 | Wu et al. | 29/622 |
| 2007/0205986 | A1 * | 9/2007 | Kim et al. | 345/168 |
| 2008/0274375 | A1 * | 11/2008 | Ng et al. | 428/687 |
| 2008/0283375 | A1 | 11/2008 | Iohara | |
| 2009/0111534 | A1 * | 4/2009 | Lu et al. | 455/575.1 |
| 2009/0114334 | A1 * | 5/2009 | Wu et al. | 156/60 |

FOREIGN PATENT DOCUMENTS

| | | |
|---|---|---|
| KR | 2007-38473 | 4/2007 |
| KR | 2007-91413 | 9/2007 |

* cited by examiner

*Primary Examiner* — Michael Friedhofer
(74) *Attorney, Agent, or Firm* — Cha & Reiter, LLC

(57) ABSTRACT

A keypad for an electronic device having metallic texture has rigidity and elasticity equivalent to those of stainless steel. The keypad is manufactured and includes a metal alloy board, a keypad body manufactured by primarily thermal-treating the metal alloy board to a rigidity enough to be molded and molding the primarily thermal-treated metal alloy board with a press, a button portion formed by secondarily thermal-treating the keypad body to cure the keypad body and etching the secondarily thermal-treated keypad body by means of etching processing, and urethane rubber and a silicon pad attached to a back surface of the keypad body which has undergone anodizing processing and various colorations.

7 Claims, 4 Drawing Sheets

KEYPAD FOR ELECTRONIC DEVICE AND METHOD FOR MANUFACTURING THE KEYPAD

CLAIM OF PRIORITY

This application claims the benefit of an earlier Korean Patent Application filed in the Korean Intellectual Property Office on Nov. 27, 2009 and assigned Serial No. 10-2009-0116259, the entire disclosure of which is hereby incorporated by reference.

BACKGROUND OF THE INVENTION

1. Field of the Invention

The present invention relates to a keypad for an electronic device having a metallic texture, and has rigidity and elasticity equivalent to those of stainless steel and allows coloration, and a method for manufacturing the keypad.

2. Description of the Related Art

Portable communication devices generally and enable users of the devices to perform wireless communications with counterpart users. Such portable communication devices include hand-held PCs (HHPs), CT-2 cellular phones, digital phones, PCS phones, and personal digital assistants (PDAs). The portable communication devices can be classified into several types. For example, portable communication devices can be basically classified into a bar-type portable communication device, a flip-type portable communication device, a folder-type portable communication device, and a slide-type portable communication device. Each device is indispensably provided with an antenna unit, data input/output units, and data transmitting/receiving units. The data input unit usually includes a keypad with which data is input by means of depressing buttons via the user's fingers.

The keypad is configured such that as a button portion exposed to outside is pressed, then a dome switch contacts a contact of a printed circuit board for input of various signals.

In the past, the keypad was usually made of soft synthetic resin such as silicon rubber. However, various metal keypads have been developed by substituting a part of synthetic resin with metal, whereby the thickness of the keypad is reduced and an unusual aesthetic sense such as expression of metal's inherent gloss is provided.

As shown in FIGS. 1 through 3, for a conventional metal keypad 1, a pattern of a keypad 3 and a plurality of button portions 3*a* are formed by performing etching on a metal plate 2 made of stainless steel, and urethane rubber 4 and a silicon pad 5 are bonded to a back surface of the keypad 3.

On the back surface of the keypad 3 is provided a light emitting device (not shown) for emitting light to the button portions (characters and symbols).

To implement various colors on the metal keypad 3, a plurality of coating layers 6 are applied to the metal plate 2.

However, when the plurality of coating layers 6 are applied to the metal plate 2, the metal's inherent texture is degraded because the thickness of the coating layer is about 30 μm.

To solve the foregoing problem, a metal plate made of aluminum may be used. In this case, after the metal plate is anodized, the device itself can be colored, thereby exhibiting metallic texture and a color at the same time.

However, in case of the conventional metal keypad made of aluminum, the material thickness should be about 0.2 mm to secure a sense of clicking and allow etching for the button portions on the back surface. However, there are drawbacks with the aluminum having such thickness as it degrades rigidity and increase susceptibility to deformation.

Accordingly, there is a need for a keypad that can improve rigidity and allow better colorations after anodization.

SUMMARY OF THE INVENTION

An aspect of the present invention is to address at least the above problems and/or disadvantages and to provide at least the advantages described below. Accordingly, an aspect of the present invention is to provide a keypad for an electronic device which allows various colorations while having a metallic texture, and has rigidity and elasticity equivalent to those of stainless steel, and a method for manufacturing the keypad.

Another aspect of the present invention is to provide a keypad for an electronic device and a method for manufacturing the keypad, in which a keypad including a metal alloy plate made of aluminum-scandium (Al—Sc) is manufactured by adding scandium to a metal plate made of aluminum, thereby increasing rigidity to a level enough to be molded to a product by means of a plurality of thermal treatment processes, and making it possible to perform anodization, which has not been conventionally available due to the rigidity of aluminum, thus allowing application of various colors on the exterior of the keypad.

According to an aspect of the present invention, there is provided a keypad for an electronic device, the keypad including a metal alloy board, a keypad body manufactured by primarily thermal-treating the metal alloy board to a rigidity enough to be molded and molding the primarily thermal-treated metal alloy board with a press, a button portion formed by secondarily thermal-treating the keypad body to cure the keypad body and etching the secondarily thermal-treated keypad body by means of etching processing, and urethane rubber and a silicon pad attached to a back surface of the keypad body which has undergone anodizing processing and coloration.

According to another aspect of the present invention, there is provided a method for manufacturing a keypad for an electronic device, the method including manufacturing a metal alloy board made of an aluminum-scandium material, primarily thermal-treating the metal alloy board to a rigidity enough to be molded, manufacturing a keypad body by molding the primarily thermal-treated metal alloy board with a press, secondarily thermal-treating the keypad body to cure the keypad body, etching the secondarily thermal-treated keypad body by means of etching processing to form a button portion, performing anodizing processing on the keypad body and coloring the keypad body, and attaching urethane rubber and a silicon pad to a back surface of the keypad body.

BRIEF DESCRIPTION OF THE DRAWINGS

The above and other features and advantages of an exemplary embodiment of the present invention will be more apparent to those skilled in the art from the following detailed description taken in conjunction with the accompanying drawings, in which.

DETAILED DESCRIPTION OF THE INVENTION

Figure 1:
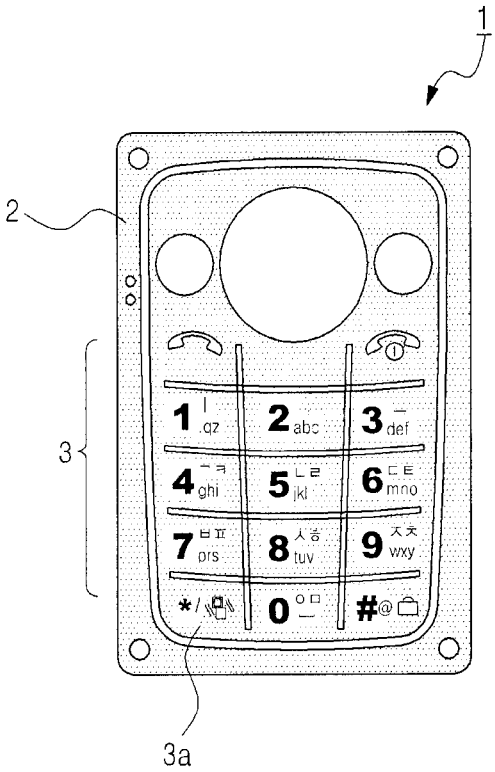
FIG.1 (PRIOR ART)
FIG. 1 is a front view showing a metal plate for manufacturing a conventional keypad.
Figure 2:
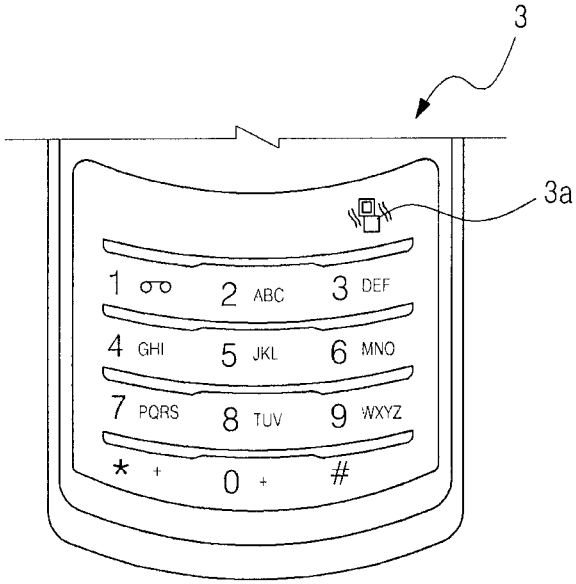
FIG.2 (PRIOR ART)
FIG. 2 is a front view showing a state of a conventional keypad after being painted.
Figure 3:
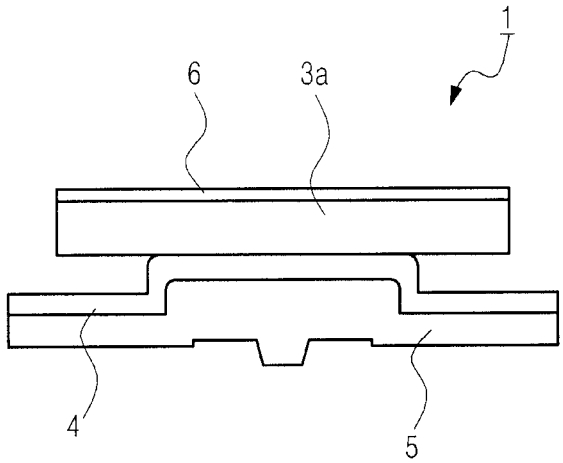
FIG.3 (PRIOR ART)
FIG. 3 is a side cross-sectional view showing a button portion of a conventional keypad.

Hereinafter, an exemplary embodiment of the present invention will be described in detail with reference to the accompanying drawings. The embodiment described herein and structures shown in the drawings are merely illustrative and do not cover every technical spirit of the invention. Therefore, it will be understood that various modifications which can substitute for the embodiment can be made at the time of filing the present application.

Figure 4:
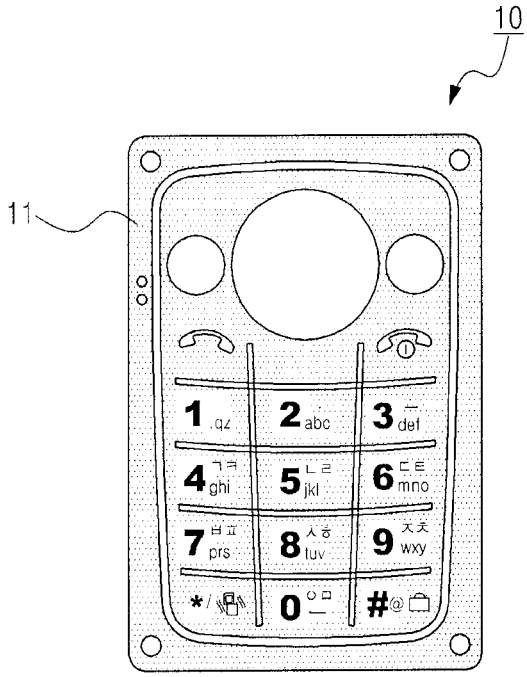
FIG. 4 is a front view showing a before-molding state of a keypad for an electronic device according to an embodiment of the present invention.
Figure 5:
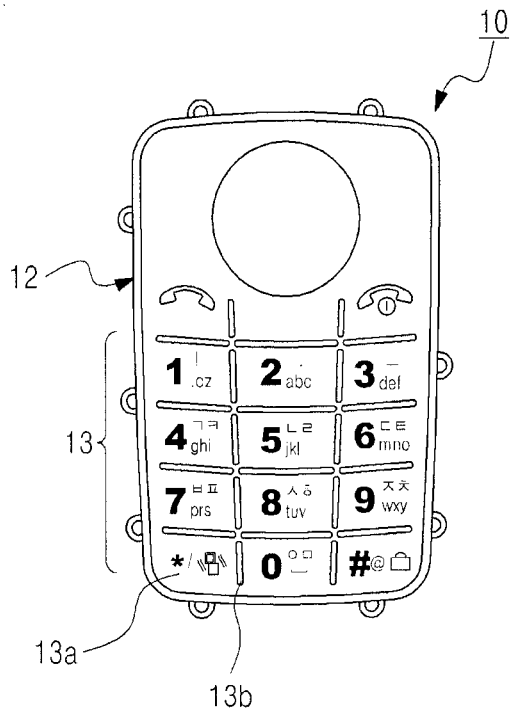
FIG. 5 is a plane view showing a keypad for an electronic device according to an embodiment of the present invention, which has been primarily and secondarily thermal-treated, molded, etched, and anodized.
Figure 6:
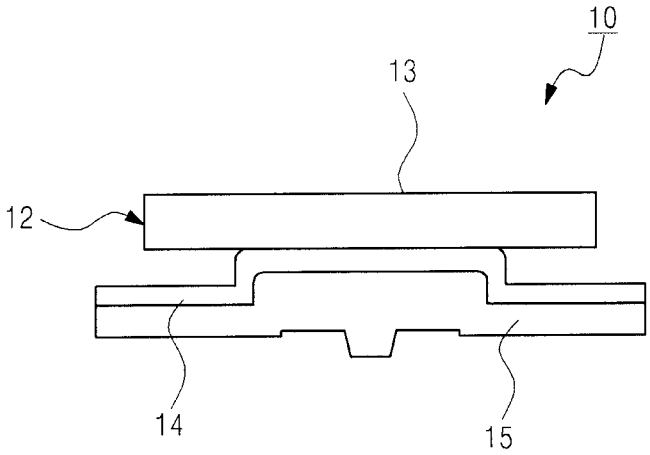
FIG. 6 is a side cross-sectional view showing a button portion of a keypad for an electronic device according to an embodiment of the present invention.

Referring to FIGS. 4 through 6, a keypad 10 for an electronic device includes a metal alloy board 11, a keypad body 12, a button portion 13, urethane rubber 14, and a silicon pad 15. The metal alloy board 11 is made of an aluminum-scandium (Al—Sc) material to increase rigidity for anodizing processing described below, in which the content of scandium is included therein is about 0.05% to about 0.25%. The metal alloy board 11 may be made of other materials than the Al—Sc material, which can increase rigidity. The keypad body 12 is adapted to be manufactured by primarily thermal-treating the metal alloy board 11 to a rigidity enough to be molded and molding the primarily thermal-treated metal alloy board 11 with a press (not shown). The button portion 13 is adapted to be formed by secondarily thermal-treating the keypad body 12 for curing the keypad body 12 and etching the secondarily thermal-treated keypad body 12 by means of etching processing. An exterior of the keypad body 12 is adapted to be colored after an anodizing process.

As shown in FIG. 6, the urethane rubber 14 and the silicon pad 15 are attached to a back surface of the keypad body 12 to contact dome switches (not shown) included in the electronic device (not shown).

Referring to FIGS. 4 through 6, the primary thermal-treatment is performed for about 120 minutes at about 460° C. to about 480° C. such that the rigidity of the metal alloy board 11 can be increased enough to be molded. The secondary thermal-treatment is performed for about 12 hours to about 24 hours at about 120° C. to cure the keypad body 12. The anodizing processing is adapted to include forming an anodic oxide film by applying current to the keypad body 12 in an anodizing solution of about 20° C. to about 40° C., then coloring the keypad body 12 with various colors.

The keypad body 12 is adapted to implement two or more colors if being repetitively surface-processed, anodized, and colored.

The button portion 13 is provided with a carved portion 13*a* which forms symbols, characters, and patterns by means of mechanical processing, laser processing, and etching processing.

The button portion 13 masks a surface except for the carved portion 13*a*, and the carved portion 13*a* includes a lighting portion 13*b* which passes therethrough light from a light source (not shown) of a light emitting device included in the electronic device.

Although the keypad 10 according to an embodiment of the present invention has been described to be used for an electronic device as a representative example, the teachings of the present invention may be applicable to various forms of electronic devices. Examples of the electronic device according to an embodiment of the present invention may include any type of information communication apparatuses and multimedia apparatuses such as mobile communication terminals, digital broadcasting terminals, Portable Multimedia Players (PMPs), MP3 players, digital broadcast players, Personal Digital Assistants (PDAs), smart phones, any duplex systems and applications thereof.

Hereinafter, a more detailed description will now be made of an operation process of a keypad for an electronic device according to an embodiment of the present invention.

As shown in FIGS. 4 through 6, the keypad 10 for an electronic device includes the metal alloy board 11 made of an aluminum-scandium (Al—Sc) material in which scandium is included in aluminum in a content of about 0.05% to about 0.25%, the keypad body 12, the button portion 13, the urethane rubber 14, and the silicon pad 15.

In this state, the metal alloy board 11 is primarily thermal-treated for about 120 minutes at about 460° C. to about 480° C. such that the rigidity of the metal alloy board 11 can be increased enough to be molded.

The primarily thermal-treated metal alloy board 11 is molded to a three-dimensional (3D) flange with a press.

The flange includes the keypad body 12.

In this state, secondary thermal-treatment is performed to cure the keypad body 12.

The secondary thermal-treatment is performed for about 12 hours to about 24 hours at about 120° C.

The secondarily thermal-treated keypad body 12 is etched by etching processing to form the button portion 13.

As shown in FIGS. 5 and 6, the button portion 13 is provided with the carved portion 13*a* which forms symbols, characters, and patterns by means of laser processing and etching processing.

The button portion 13 masks a surface except for the carved portion 13*a*, and the carved portion 13*a* includes the lighting portion 13*b* which passes therethrough light from a light source (not shown) of a light emitting device included in the electronic device.

In this state, as shown in FIGS. 4 through 6, after anodizing processing is applied to the keypad body 12, the keypad body 12 is colored with various colors as desired. The anodizing processing includes forming the carved portion 13*a* by performing mechanical processing or etching processing on the keypad body 12 whose rigidity is increased by the secondary thermal-treatment, forming an anodic oxide film by applying current to the keypad body 12 in an anodizing solution of about 20° C. to about 40° C., and then coloring the keypad body 12 with various colors.

The keypad body 12 can implement two or more colors if being repetitively surface-processed, anodized, and colored.

The urethane rubber 14 and the silicon pad 15 are attached to the back surface of the keypad body 12.

Figure 7:
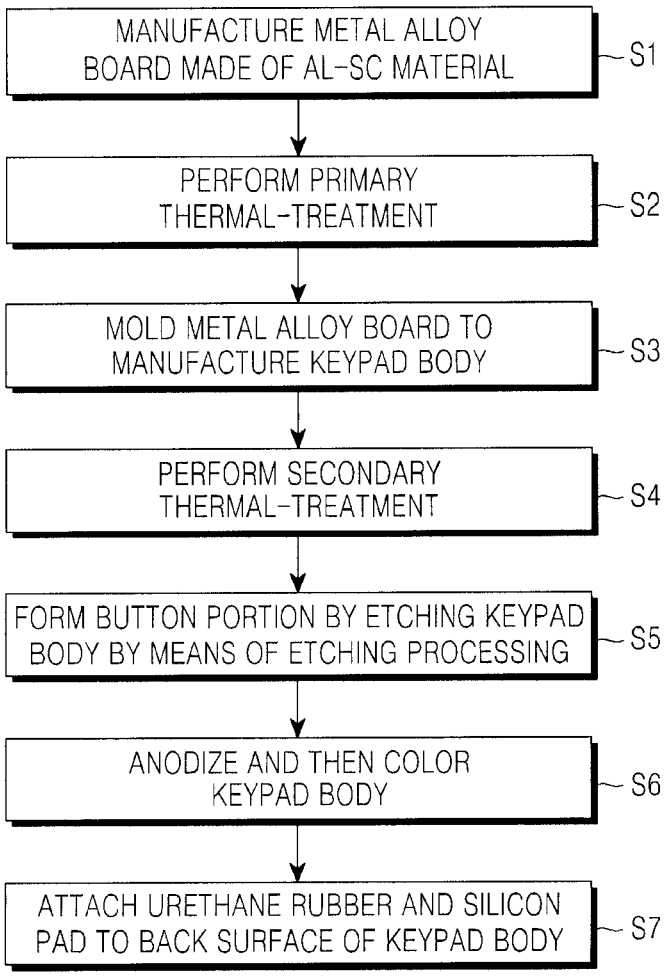
FIG. 7 is a flowchart illustrating a method for manufacturing a keypad for an electronic device according to an embodiment of the present invention.

With reference to FIG. 7, a more detailed description will be made of a method for manufacturing the keypad 10 for an electronic device according to an embodiment of the present invention.

As shown in FIG. 7, formed in step S1 is the metal alloy board 11 made of an aluminum-scandium (Al—Sc) material in which scandium is included in aluminum in a content of about 0.05% to about 0.25%.

In step S2, the metal alloy board 11 is primarily thermal-treated for about 120 minutes at about 460° C. to about 480° C. to a rigidity enough to be molded.

In step S3, the primarily thermal-treated metal alloy board 11 is molded to a 3D flange with a press, in which the flange includes the keypad body 12.

In step S4, the keypad body 12 is secondarily thermal-treated for about 12 hours to about 24 hours at about 120° C. to cure the keypad body 12.

In step S5, the button portion 13 is formed by etching the secondarily thermal-treated keypad body 12 by means of etching processing.

The button portion 13 is provided with the carved portion 13*a* which forms symbols, characters, and patterns by means of mechanical processing, laser processing, and etching processing.

The button portion 13 masks a surface except for the carved portion 13*a*, and the carved portion 13*a* includes the lighting portion 13*b* which passes therethrough light from a light source (not shown) of a light emitting device included in the electronic device.

In step S6, after anodizing processing is applied to the keypad body 12, the keypad body 12 is colored with various colors.

The anodizing processing includes forming the carved portion 13*a* by performing mechanical processing or etching processing on the keypad body 12 whose rigidity is increased by the secondary thermal-treatment, forming an anodic oxide film by applying current to the keypad body 12 in an anodizing solution of about 20° C. to about 40° C., and then coloring the keypad body 12 with various colors.

The keypad body 12 can implement two or more colors if being repetitively processed, anodized, and colored.

In step S7, the urethane rubber 14 and the silicon pad 15 are attached to the back surface of the keypad body 12.

As is apparent from the foregoing description, a keypad body having a rigidity increased by primarily thermal-treating, secondarily thermal-treating, and molding a metal alloy board made of an aluminum-scandium material is manufactured, and the manufactured keypad body is colored with various colors after undergoing etching processing and anodizing processing, thereby making a product design elegant and improving the exterior of the product.

It will be obvious to those of ordinary skill in the art that the above-described keypad for an electronic device and method for manufacturing the keypad according to the present invention are not limited to the foregoing embodiment and drawings, and various changes in form and details may be made therein without departing from the spirit and scope of the invention as defined by the appended claims.

What is claimed is:

1. A keypad for an electronic device, the keypad comprising:

a metal alloy board;

a keypad body manufactured by primarily thermal-treating the metal alloy board to a rigidity enough to be molded and molding the primarily thermal-treated metal alloy board with a press;

a button portion formed by secondarily thermal-treating the keypad body to cure the keypad body and etching the secondarily thermal-treated keypad body by means of etching processing; and a urethane rubber and a silicon pad coupled to a back surface of the keypad body which has undergone anodizing processing and coloration.

2. The keypad of claim 1, wherein the metal alloy board is made of an aluminum-scandium (Al—Sc) material in which scandium is included in a content of about 0.05% 0.25%.

3. The keypad of claim 1, wherein the primary thermal-treatment is performed on the metal alloy board for about 120 minutes at about 460° C. to about 480° C.

4. The keypad of claim 1, wherein the secondary thermal-treatment is performed on the keypad body for about 12 hours to about 24 hours at about 120° C.

5. The keypad of claim 1, wherein the anodizing processing comprises forming an anodic oxide film by applying current to the keypad body in an anodizing solution of about 20° C. to about 40° C., and coloring the keypad body.

6. The keypad of claim 1, wherein the keypad body implements two or more colors if being repetitively surface-processed, anodized, and colored.

7. The keypad of claim 1, wherein the button portion is provided with a carved portion which forms symbols, characters, and patterns by means of laser processing and etching processing, and the button portion masks a surface except for the carved portion, and the carved portion comprises a light portion which passes therethrough light from a light source of a light emitting device included in the electronic device.

* * * * *